US008059045B1

(12) United States Patent
Schaffner et al.

(10) Patent No.: US 8,059,045 B1
(45) Date of Patent: Nov. 15, 2011

(54) ANTENNA HAVING AN IMPEDANCE MATCHING SECTION FOR INTEGRATION INTO APPAREL

(75) Inventors: James H. Schaffner, Chatsworth, CA (US); Tsung-Yuan Hsu, Westlake Village, CA (US); Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 604 days.

(21) Appl. No.: 12/193,500

(22) Filed: Aug. 18, 2008

(51) Int. Cl.
*H01Q 1/12* (2006.01)
*H01Q 1/36* (2006.01)

(52) U.S. Cl. ..... 343/718; 343/895

(58) Field of Classification Search ..... 343/718, 343/895

See application file for complete search history.

(56) References Cited

U.S. PATENT DOCUMENTS

| | | | | |
|---|---|---|---|---|
| 3,417,400 | A | 12/1968 | Black | |
| 3,735,293 | A | 5/1973 | Breitenbach | 333/237 |
| 3,781,725 | A | 12/1973 | Yoshida | 333/237 |
| 3,909,757 | A | 9/1975 | Miyamoto | 333/237 |
| 4,129,841 | A | 12/1978 | Hildebrand et al. | |
| 4,152,648 | A | 5/1979 | Delogne | |
| 4,339,733 | A | 7/1982 | Smith | |
| 4,376,941 | A * | 3/1983 | Zenel | 343/709 |
| 4,987,394 | A | 1/1991 | Harman et al. | |
| 5,247,270 | A | 9/1993 | Harman | 333/237 |
| 5,936,203 | A | 8/1999 | Ryman | |
| 6,525,692 | B2 * | 2/2003 | Kim et al. | 343/702 |
| 7,471,258 | B2 | 12/2008 | Hsu | 343/895 |

OTHER PUBLICATIONS

Adams, R.C., et al., "COMWIN Antenna System Fiscal Year 200 Report," SPAWAR, Technical Report 1836, (Sep. 2000).
Cohn, S.B., "Optimum Design of Stepped Transmission Line Transformers," IRE Trans. Microwave Theory Tech., vol. MTT-3, pp. 16-21 (Apr. 1955).
Kumar, G., et al., "Broadband Microstrip Antennas," Table 2, p. 43, Artech House (2003).
Suzuki, T., et al., "Design of a tunnel relay system with a leaky coaxial cable in an 800MHz band land mobile telephone system," Vehicular Technology, IEEE Transactions on, vol. 29, No. 3, pp. 305-316 (Aug. 1980).
Thomas, R.W., et al., "Radiax™, a new radiating coaxial cable," Vehicular Technology Conference, 22nd IEEE, vol. 22, pp. 430-439, (Dec. 7-8, 1971).
Wait, J.R., "Electromagnetic Theory of the Loosely Braided Coaxial Cable :Part 1," IEEE Transactions on Microwave Theory and Techniques, vol. MIT-24, No. 9 (Sep. 1976).
U.S. Appl. No. 12/252,189, filed Oct. 15, 2008, Hsu.

* cited by examiner

*Primary Examiner* — Tan Ho
(74) *Attorney, Agent, or Firm* — Ladas & Parry

(57) ABSTRACT

An antenna having an impedance matching section for attaching to a sheet or a garment. The antenna has a first, a second, and a third leaky substantially coaxial conductor. The first and the third coaxial conductors have an electrically conductive layer placed on the dielectric in a double helix. The second coaxial conductor has an electrically conductive layer placed on the dielectric in a single helix. The first coaxial conductor is coupled to the second coaxial conductor, the second coaxial conductor is coupled to the third coaxial conductor; and the third coaxial conductor is coupled in use to a first termination impedance. Methods to make the foregoing structures are also described.

22 Claims, 9 Drawing Sheets

ANTENNA HAVING AN IMPEDANCE MATCHING SECTION FOR INTEGRATION INTO APPAREL

STATEMENT REGARDING FEDERALLY SPONSORED RESEARCH OR DEVELOPMENT

This invention was funded by the government under contract number W155P7T-06-C-P608 awarded by Army CERDEC. The U.S. Government has certain rights in this technology.

RELATED APPLICATIONS AND PATENTS

This invention is related to the disclosure of US Patent Pub. No. 2007/0252777.

BACKGROUND

1. Technical Field

This disclosure is generally related to flexible antennas having materials that leak radio frequency (RF) energy and, in particular, to an antenna having an impedance matching section.

2. Description of Related Art

A typical antenna suitable for attaching to clothing 100 is a patch or dipole-based antenna or similar as shown in FIG. 1. Radiating coaxial antennas having helical outer conductors are typically used for communication in a highway tunnel. Radiating coaxial cables have been used within tunnels and buildings where electromagnetic propagation is difficult and where wireless communication is desired over a wide area as disclosed by Suzuki, T.; Hanazawa, T.; Kozono, S., "Design of a tunnel relay system with a leaky coaxial cable in an 800 MHz band land mobile telephone system," *Vehicular Technology*, IEEE Transactions on, Volume 29, Issue 3, August 1980, Page(s): 305-316. Typically, the radiation will leak away from the coaxial cable, from openings in the outer conductor of the cable as disclosed by Thomas, R. W.; Brown, J. S, "Radiax™, a new radiating coaxial cable," Vehicular Technology Conference, 1971. 22nd IEEE Volume 22, 7-8 Dec. 1971 Page(s): 430-439. Such antennas are sometimes termed as "leaky" antennas. The leaky coaxial cable is inherently a broadband traveling wave antenna, since the dominant feed mode is transverse electromagnetic mode (TEM).

Such radiating coaxial antennas tend to be long antennas that leak electromagnetic energy from a coaxial cable at a slow rate, owing to a poor radiating efficiency. An existing antenna has a leakage rate of 3 dB per 100 feet. In particular, patch and dipole-based antennas tend to be narrowband and have a limited field of view (FOV), typically a maximum of 100° as described in "Broadband Microstrip Antennas," G. Kumar, K. P. Ray, Artech House, 2003, in Table 2 on page 43. Further, because of dimensions and/or layout, such antennas are ill-suited for attaching to clothing.

Another leaky coax is disclosed by Henry Ryman in "Radiating Coaxial Cable with Outer Conductor Formed by Multiple Conducting Strips," U.S. Pat. No. 5,936,203, Aug. 10, 1999. The '203 patent teaches a use of a single or a double wound helical strip to form a leaky wave outer conductor shield for a radiating coaxial cable. Examples of openings permitting leakage of radio frequency energy from the cable are shown in FIGS. 2 and 3 discussed below.

FIGS. 2*a* and 2*b* show a segment 200 of Ryman's single helix leaky cable. A conductor 205, having a length L, is enclosed in a dielectric 215. A conducting film or strip 225 is wound in a single helix on the dielectric 215. The conducting film or strip 225 has a width W and a pitch P. An impedance of the existing antenna is controllable by a variation of the width W of the conducting film or strip 225.

FIGS. 3*a* and 3*b* show a segment 300 of Ryman's double helix leaky cable. A conductor 305, having a length "L," is enclosed in a dielectric 315. A conducting film or strip 325 is wound in a first helix. An additional conducting film 335 is counterwound in a second helix on the dielectric 315. The conducting film or strip 325 has a width W1 and a pitch P1. The additional conducting film 335 has a width W2 and a pitch P2. It should be noted here that W1 and W2 may be the same or different depending on a given application. Similarly, P1 and P2 may be the same or different depending on a given application. Further, P1 may be different from W1 and P2 may be different from W2. Any of W1, W2, P1, and P2 may be varied to arrive at a desired impedance or radiation leakage rate. It may be pertinent to note that the leakage radiation occurs because of a discontinuity.

The use of multiple quarter-wave transmission line sections of prescribed impedances is taught by Cohn, S. B., "Optimum Design of Stepped Transmission Line Transformers," *IRE Trans. Microwave Theory Tech.*, Vol. MTT-3, pp. 16-21, April, 1955.

The related application identified above teaches a radiating coaxial cable transmission line that may be used as an antenna and incorporated into a garment. Mechanisms are incorporated into the antenna for boosting the rate of conversion of bifilar mode to monofilar mode.

BRIEF SUMMARY

Embodiments of the present disclosure provide a system and method for making an antenna. A method of designing the disclosed antenna is also presented.

This disclosure teaches a substantial improvement by utilizing both double wound helical strips and single wound helical strips in the same antenna. The double wound helical strips are used as impedance matching sections, while the single wound helical strips are used as efficient radiators. Thus the antenna has an overall higher efficiency.

The antenna of this disclosure is a leaky, traveling wave coaxial antenna that has an advantage of being inherently broadband. Since the antenna is made with a thin diameter cable, the antenna can also be routed throughout clothing so that the antenna can transmit and receive signals all around a human body, for example, thus providing a very wide FOV over a broad band of frequencies. The FOV can be enhanced by connecting two leaky coaxial antennas with a splitter and routed around different parts of a vest or a jacket. Leaky radiation from or into the antenna occurs by using a helical conductive strip wound around the outside of the dielectric.

The method and structure of making the antenna of the present disclosure, through a use of both single and double helical outer conductors to provide an impedance match and to radiate (or receive) efficiently in 1-2 meters, provides an example of body worn antennas.

This disclosure also describes how to match impedances between the antenna and a transceiver through experimentation and simulation.

One embodiment of the invention, among others, can be implemented as follows. An antenna is provided for a telecommunications device having a characteristic output impedance. The antenna comprises: (i) at least one impedance matching section comprising a leaky coaxial cable having a first end for attachment either to the telecommunications device or to a preceding quarter wave impedance matching section and having a second end, the leaky coaxial conductor being configured to leak radio-frequency energy, the leaky coaxial cable including a center conductor enclosed in a dielectric and an electrically conductive layer forming a double helix of conductive elements disposed on said dielectric, the conductive elements each having a width and a pitch, the widths and pitches being measured along a length of the leaky coaxial cable, the pitch of the conductive elements in said double helix being greater than the width of the conductive elements in said double helix; and (ii) an additional leaky section having a first end coupled to the second end of a final one of said at least one quarter wave impedance matching section and having a second end, the additional leaky coaxial conductor being configured to leak radio-frequency energy, the additional leaky coaxial conductor including a center conductor enclosed in a dielectric and an electrically conductive layer forming a single helix of conductive elements disposed on said dielectric, the conductive elements having a width and a pitch, the width and pitch being measured along a length of the additional leaky section, the pitch of the conductive elements in said single helix being greater than the width of the conductive elements in said single helix. The additional leaky coaxial conductor has a characteristic impedance higher than the characteristic output impedance of telecommunications device and at least one of said quarter wave impedance matching sections is coupled, in use, between the telecommunications device and the additional leaky coaxial conductor.

An exemplary preferred embodiment has the antenna or at least the additional leaky section thereof integrated into a garment or item of clothing.

In another embodiment the invention may be viewed as a leaky coaxial cable having first and second sections, the first and second sections of the leaky coaxial cable sharing a common center conductor and sharing a common dielectric sheath surrounding the center conductor, the first and second sections of the leaky coaxial cable having a leaky outer shield formed by conductive elements which are arranged in a double helix when disposed on said common dielectric sheath in said first section and which are arranged in a single helix when disposed on common dielectric sheath in said second section.

The present disclosure can also be viewed as providing a method of making an antenna. The method may include (i) providing a first leaky coaxial cable configured to leak radio-frequency energy, the first leaky coaxial cable including an inner conductor enclosed in a dielectric with an electrically conductive outer layer disposed on the dielectric, the electrically conductive outer layer having a width and a pitch, the width being measured along a length of the cable, the pitch being greater than the width, the electrically conductive layer being placed on the dielectric in a double helix, the first leaky coaxial cable having a length essentially equal to a quarter wavelength at a nominal operating frequency of the antenna; and (ii) providing a second leaky coaxial cable configured to leak radio-frequency energy, the second leaky substantially coaxial cable including an inner conductor enclosed in a dielectric with an electrically conductive outer layer disposed on the dielectric, the electrically conductive outer layer of the second leaky cable having a width and a pitch, the width being measured along a length of the cable, the pitch being greater than the width, the electrically conductive layer being placed on the dielectric in a single helix, the second leaky coaxial cable having a length substantially longer than a quarter wavelength at the nominal operating frequency of the antenna. The dielectric of the first and second leaky coaxial cables preferably has a constant diameter throughout said first and second leaky coaxial cables; and the inner conductor of the first and second leaky coaxial cables is preferably an integral member for first and second leaky coaxial cables and has a constant diameter throughout said first and second leaky coaxial cables.

Other systems, methods, features, and advantages of the present invention will be, or will become apparent, to a person having ordinary skill in the art upon examination of the following drawings and detailed description. It is intended that all such additional systems, methods, features, and advantages included within this description, be within the scope of the present disclosure, and be protected by the accompanying claims.

BRIEF DESCRIPTION OF THE SEVERAL VIEWS OF THE DRAWINGS

Many aspects of the disclosure can be better understood with reference to the following drawings. Components in the drawings are not necessarily to scale, emphasis instead being placed upon clearly illustrating principles of the present invention. The elements numbers used herein to identify elements comprise three digits. The first digit usually (but not always) refers to the figure number in which the element is depicted. The next two digits are intended to differentiate one element from another in a given figure; for example, elements 205, 305 and 605 each refer to a center conductor disposed in a dielectric sheath or core 215, 315 and 615. In many embodiments these elements with common two trailing digits are at least associated with one another if not the very same element. For example, center conductor 605 have be formed by center conductors 205 and 305 formed of the same or different electrically conductive materials with the same or different diameters. Preferably, center conductors 605, 205 and 305 are all formed of common conductor of uniform material content and uniform diameter.

DETAILED DESCRIPTION

The present disclosure relates to a system and method for making a flexible antenna, for example, having a pre-determined impedance and preferably a consistent loss per unit length along most of the length of the antenna. Specifically, the disclosed system and method may be used to make and/or design a compact antenna, for example, for attaching to a flexible surface, such as a sheet or fabric of an apparel item.

Figures 4A, 4B:
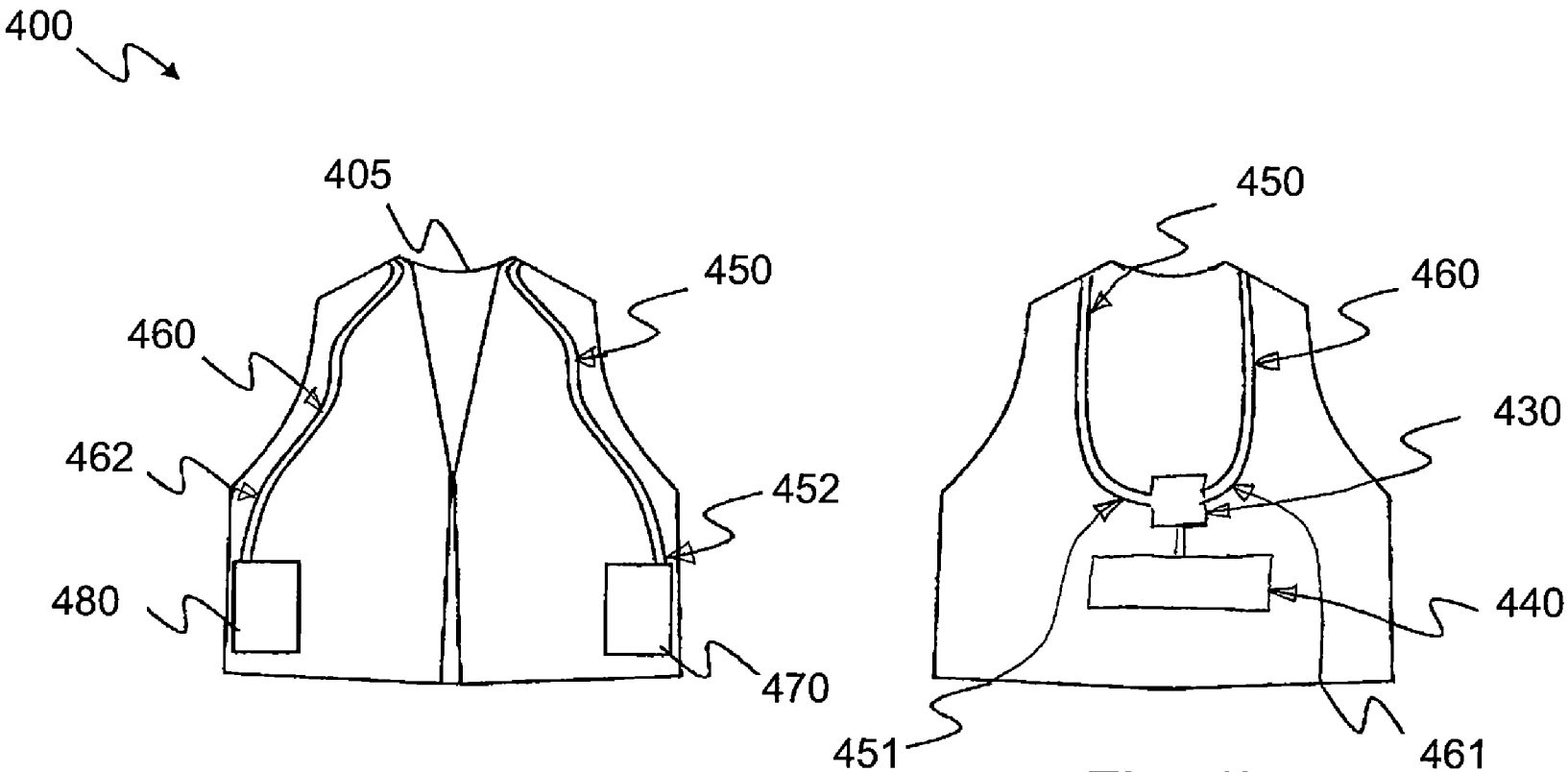
FIG. 4*a* is a front view and FIG. 4*b* is a back view of an apparel item that includes an antenna in accordance with the present disclosure.

FIG. 4*a* is a front view and FIG. 4*b* is a back view of an apparel item 405 that includes an antenna 400 of the present disclosure. FIGS. 4*a* and 4*b* show an antenna 400 attached to a garment, namely a vest 405 in this embodiment. A radio transceiver 440 is associated with the vest (it may be stowed in a pocket of the vest for example). A first portion 450 of the antenna 400 has a first end 451 and a second end 452 and a second portion 460 of the antenna 400 has a first end 461 and a second end 462. The first end 451 of the first portion 450 is preferably connected to a splitter 430 (although it may be alternatively connected directly to transceiver 440). The splitter 430 may be simply a coaxial tee with SMA connectors, for example. The first end 461 of the second portion 460 is also connected to the splitter 430 (if used, otherwise the second portion 460 may be omitted or used only for back up purposes). As will be seen with reference to FIGS. 6*a* and 6*b*, the first and second portions 450, 460 (and additional similar portions, if utilized) are preferably each made up of at least one double helix impedance matching section 604 and an additional leaky section 610 whose electrically conductive layer 609 is formed as single helix.

The splitter 430 is connected to a radio transceiver 440. It may be noted that the antenna 400 may perform even when the first end 151 of the first portion 450 is connected directly to the radio transceiver 440 without including the splitter 430 or utilizing the second portion 460. Similarly, the antenna 400 may perform even when the first end 461 of the second portion 460 is connected directly to the radio transceiver 440 without including the splitter 430 and omitting the first portion 450. That is, the antenna 400 may perform with either the first end 151 of the first portion 450, or the first end 461 of the second portion 460, connected directly to the radio transceiver 440 without utilizing the splitter 430.

The second end 452 of the first portion 450 is preferably connected to a first termination impedance 470. The second end 462 of the second portion 460 is likewise preferably connected to a second termination impedance 480. And, as will be seen, the first end or ends of the portions 450 and/or 460 of the antenna are preferably connected via impedance matching section(s) 604 to be described with reference to FIGS. 6*a* and 6*b*. In experiments described below, the antenna 400 has been found to have a radiation leakage rate of 5 dB per foot.

Table I lists performance features of a leaky coaxial cable with a single helix and a leaky coaxial cable with a double helix showing measured results from 1-3 GHz from both types of leaky coaxial cables, each 1 meter long. Simulations and experiments were performed on coaxial cables with single and double wound helices. It was found that the coaxial cable with the single wound helix had the most efficient radiation, whereas the coaxial cable with the double wound helix had the lowest reflection from the source. The center conductor of each cable had a 0.116 cm diameter, and it was surrounded by a Teflon dielectric sheath or core of diameter 0.305 cm (standard 0.141 semi-rigid coaxial cable). The pitch of the helices in both cables was 0.5 cm. The helix outer conductors were fabricated from copper tape, 0.005 cm thick, of width 0.318 cm for the single wound helix and 0.159 cm for the double wound helix. In those measurements, the cables were stretched straight and the radiation was into absorbing material. It was assumed that within a one meter section of leaky cable the conductor losses were minimal, and that most of the loss could be attributed to radiation. The results of Table I are averaged from 1-3 GHz. From the Table 1, it can be seen that the leaky coaxial cable with the single wound helix radiates more efficiently than the leaky coaxial cable with two counter wound helices. However, the reflection from the cable with the single wound helix was larger than the cable with the double wound helix. These trends were found to hold for other single and double helix dimensions and pitches as well.

TABLE I

| Cable Outer Conductor Type | Single Helix | Double Helix |
|---|---|---|
| Total Length | 1 meter | 1 meter |
| Average Radiation and Loss % | 47 | 34 |
| Average Reflection % | 16 | 9 |
| Average % of Power into Load | 37 | 67 |

Figure 5:
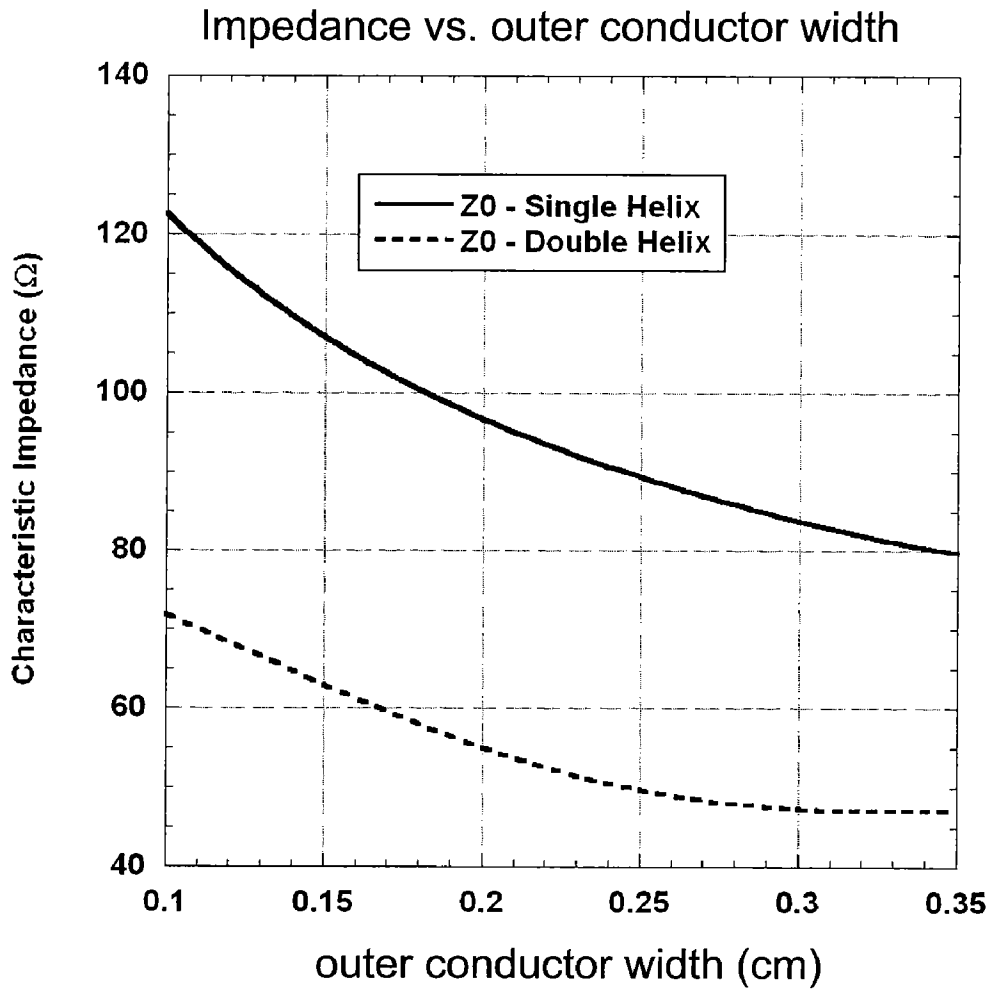
FIG. 5 illustrates plots of electrically conductive layer width versus characteristic impedance, a plot each for a single helix and a double helix.

FIG. 5 illustrates plots of a width of an electrically conductive layer versus a characteristic impedance, a plot each for a single helix and a double helix. Electromagnetic simulations, using Ansoft HFSS®, were performed on cable sections with the single and double helix outer conductor for a pitch of 0.5 cm, but of varying conductor widths. The characteristic impedances of these leaky cables were determined, and are shown in FIG. 5. The simulations showed that the single helix leaky coaxial cable had a characteristic impedance higher than the double helix leaky coaxial cable, and thus would have a larger impedance mismatch into a 50 antenna connector commonly found on transceivers such as transceiver 440. It may be seen that the characteristic impedance decreases with an increase in the width of the electrically conductive layer.

Figure 3A:
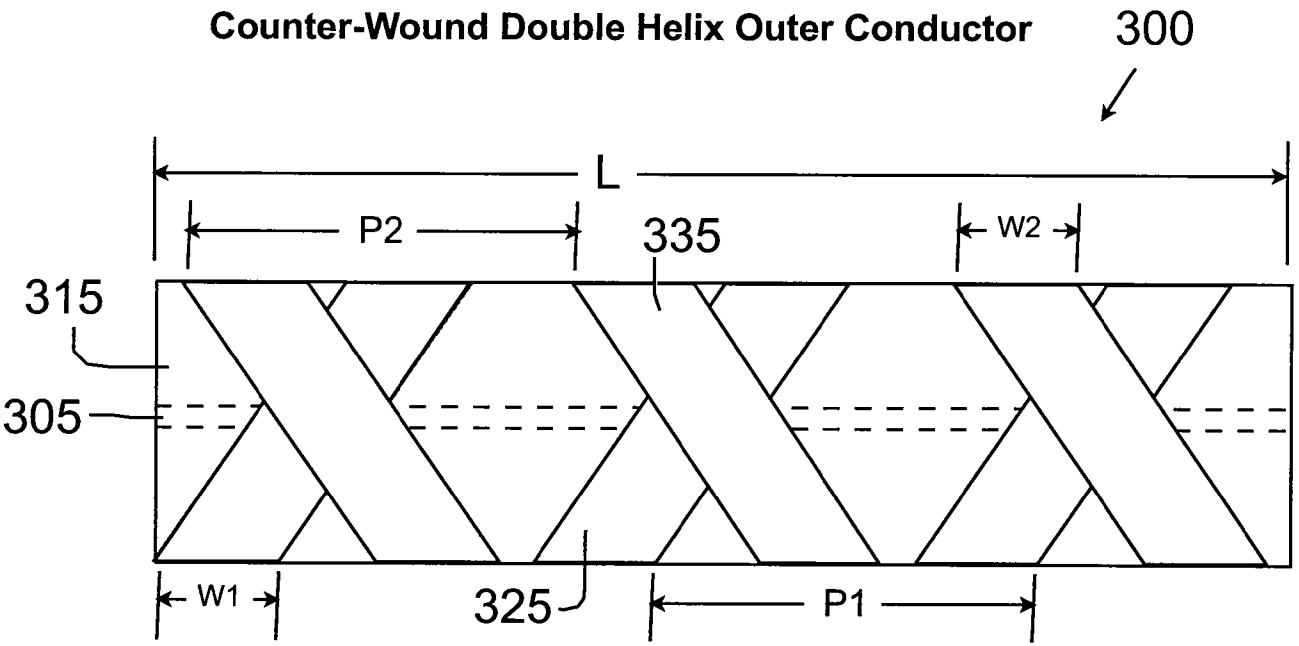
Figure 3a (Prior Art)
FIGS. 3*a* and 3*b* illustrates a prior art double helix leaky coaxial cable, with FIG. 3*a* being an end view and FIG. 3*b* being a side elevational view, both views showing the leaky coaxial cable with its conventional outer dielectric covering being cut away.
Figure 3B:
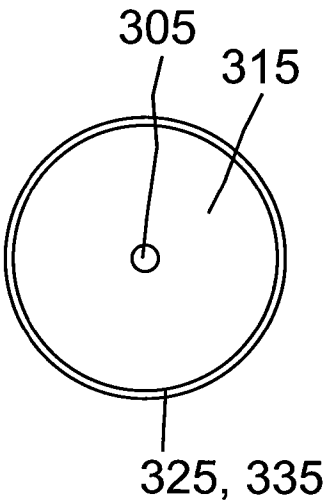
Figure 3b (Prior Art)
Figure 6A:
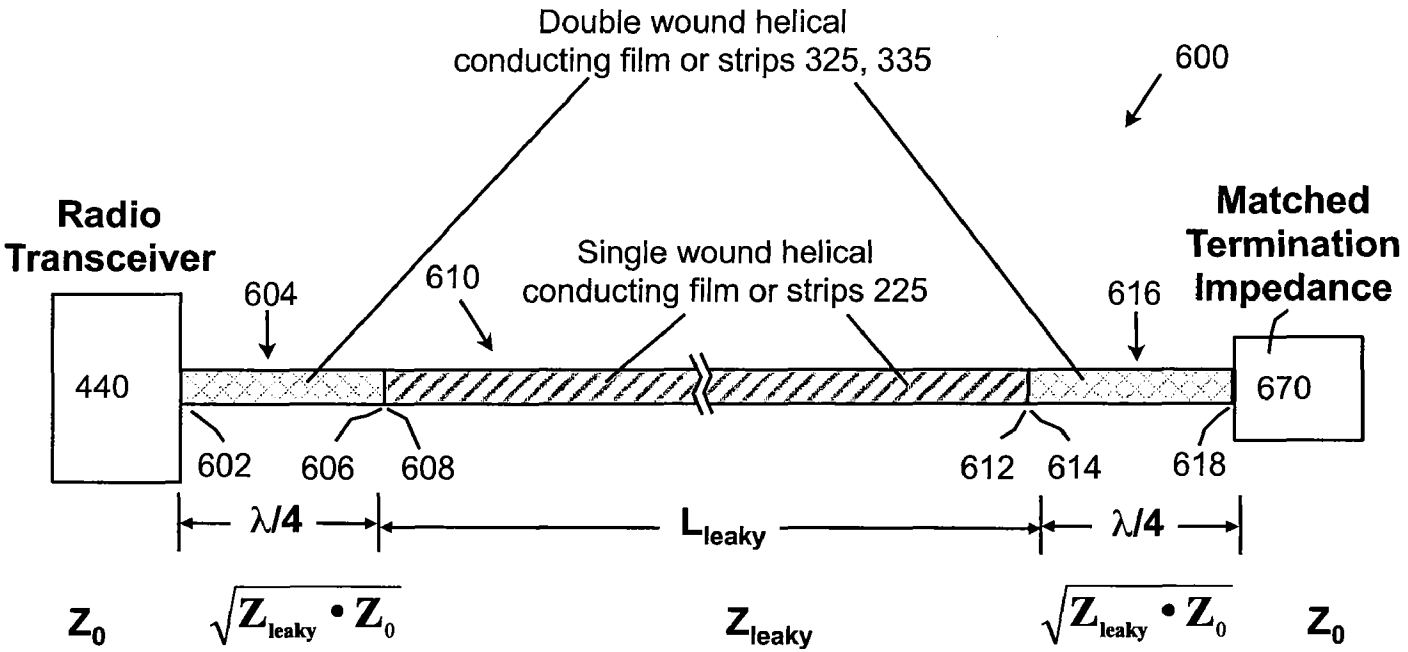
FIG. 6*a* illustrates the antenna, having single helix and double helix sections, connected to a radio transceiver and termination impedance
Figure 6B:
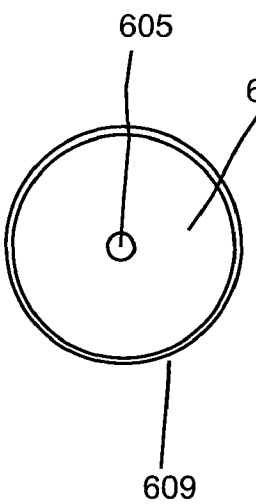
FIG. 6*b* is an enlarged cross-sectional view through the helix sections thereof.

Turning now to FIG. 6*a*, this figure illustrates an antenna 600 (corresponding to element 400 in FIG. 4*a*), connected to a radio transceiver 440 and a matched termination impedance 670 (corresponding to element 470 in FIG. 4*a*) or an additional or second termination impedance 480 (see also FIG. 4*a*) based on a given configuration. Antenna 600 has a first end 602 and a second end 618, the antenna may include one or more impedance matching section(s) 604. Only one impedance matching section 604 is shown in FIG. 6*a*, but it is to be understood that a number of serially connected impedance matching sections 604 may be employed in lieu of the single impedance matching section 604 shown in this figure. The impedance matching section(s) 604 are preferably formed a leaky substantially coaxial conductor having a first end 602 and a second end 606, configured to leak radio-frequency energy, the leaky coaxial conductor including a center conductor 605 (see also FIG. 6*b* which is a sectional view through the helix portions of the antenna 600) enclosed in a dielectric sheath or core 615 with an electrically conductive layer 609 disposed on dielectric sheath or core 615. The electrically conductive layer 609 intentionally leaks RF energy applied to the antenna through openings in the electrically conductive layer 609. The electrically conductive layer 609 as it covers the dielectric sheath or core 615 in the impedance matching sections 604, 616 is preferably formed as a double helix having an electrically conductive layer 609 formed of conducting film or strips 325, 335 with a width (W1 for example) and a helix pitch (P1 for example) (see FIGS. 3*a* and 3*b*), the width and pitch being measured along a length of the center conductor 605, the pitch being greater than the width. The width and pitch of the two conducting film or strips 325, 335 forming the double helix have the same or different widths and/or pitches, but the pitches are wider than the widths so that openings are formed in electrically conductive layer 609

(corresponding to electrically conductive strips 325, 335 in FIGS. 3*a* and 3*b*) to permit RF energy to leak away from the cable.

Figure 1:
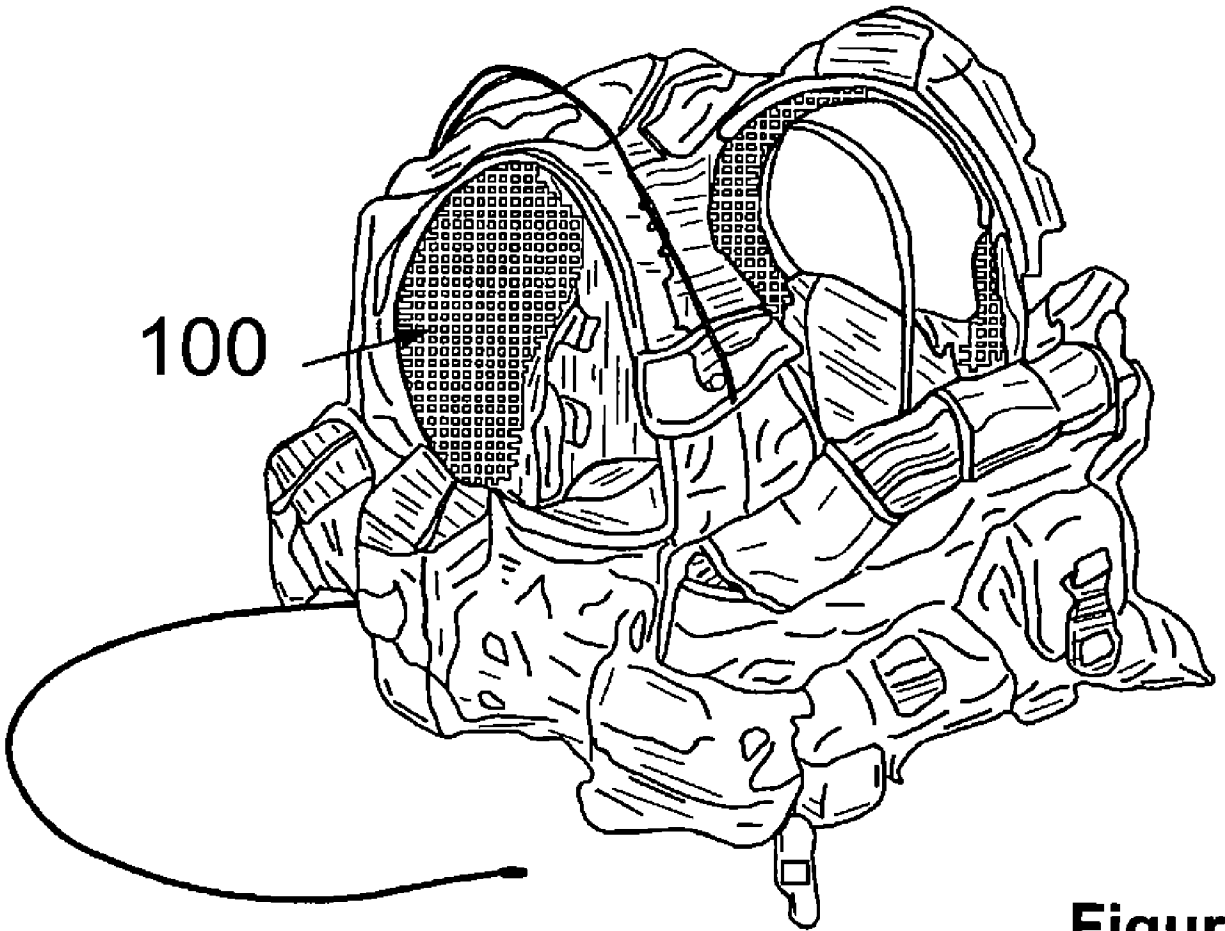
Figure 1 (Prior Art)
FIG. 1 is an example of a prior art application of a coaxial leaky antenna in a utility vest.
Figure 2A:
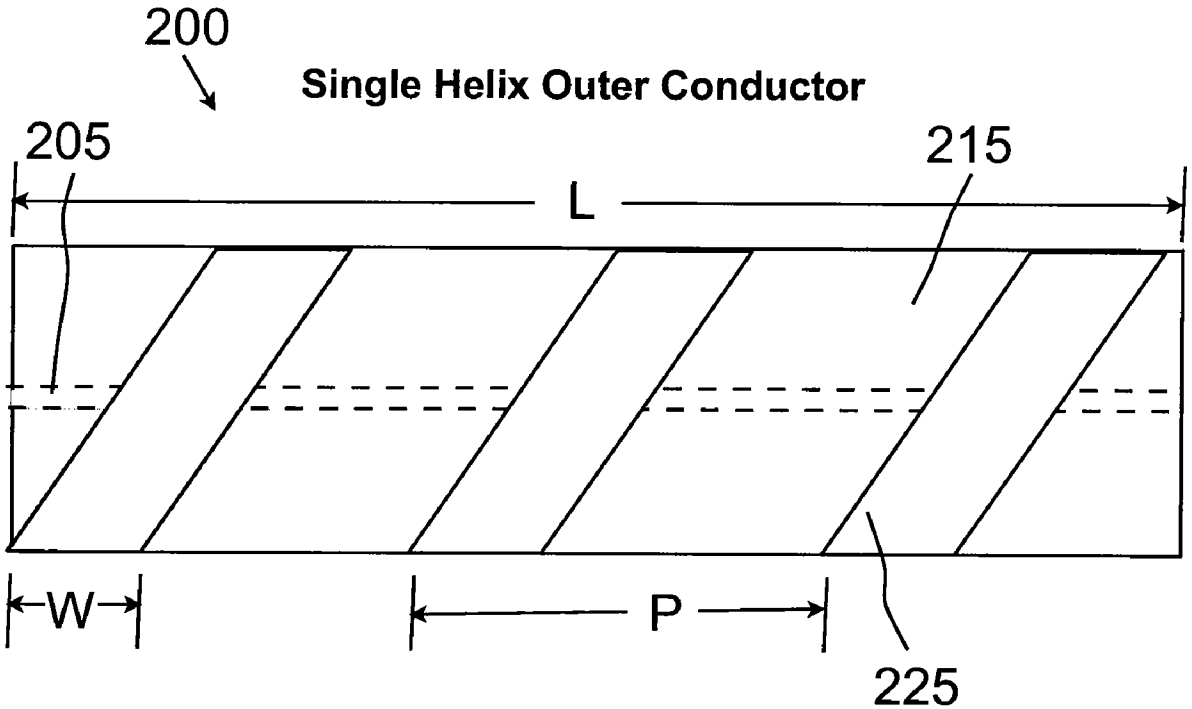
Figure 2a (Prior Art)
FIGS. 2*a* and 2*b* illustrate a prior art single helix leaky coaxial cable, with FIG. 2*a* being an end view and FIG. 2*b* being a side elevational view, both views showing the leaky coaxial cable with its conventional outer dielectric covering being cut away.
Figure 2B:
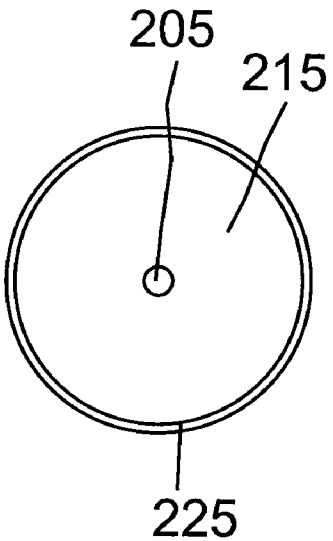
Figure 2b (Prior Art)

An additional leaky section 610 having a first end 608 and a second end 612 is coupled to the impedance matching section(s) 604, 616. The impedance matching section 616 at the distal end of the additional leaky section 610 is also referred to as a termination section herein. The additional leaky section 610 is preferably formed as a coaxial cable configured to leak radio-frequency energy though openings in its electrically conductive layer 609, the additional leaky section 610 including a center conductor 605 enclosed in a dielectric sheath or core 615 as before, but the electrically conductive layer 609 is formed as a single helix (as opposed to as a double helix in the impedance matching sections(s) 604, 616), the single helix having a width W and a pitch P (see FIGS. 2*a* and 2*b*), the width W being measured along a length of the center conductor 605, the pitch P being greater than the width, the electrically conductive layer 609 being placed on the dielectric sheath or core 615 in a single helix.

Preferably, the center conductor 605 and the surrounding dielectric sheath or core 615 have the same dimensions and materials for both the impedance matching section(s) 604, 616 and the additional leaky section 610.

Depending on the length of the additional leaky section 610 and its propensity to leak RF energy, an additional impedance matching section or termination section 616 may be desirable if unwanted reflections would otherwise occur at the distal end 612 of the additional leaky section 610. If used, the termination section 616 is coupled to the distal end 612 of the additional leaky section 610. A matched termination impedance 670 may likewise be coupled to a distal end 618 of the termination section 616.

If utilized, the termination section 616 preferably comprises yet another leaky coaxial cable having a first end 614 and a second end 618, which cable is likewise configured to leak radio-frequency energy. This termination section 616, if utilized, preferably includes a center conductor 605 enclosed in a dielectric sheath or core 615 and electrically conductive layer 609 arranged again in a double helix as in the case of the impedance matching section 604. The double helix has a width (W1 for example) and a helix pitch (P1 for example) (see also FIG. 3), the width being measured along a length of the center conductor 605, the pitch being greater than the width, the electrically conductive layer 609 being placed on the dielectric sheath or core 615 in a double helix. The second end 606 of the leaky coaxial conductor forming impedance matching section 604 may be coupled, in use, to the first end 608 of the additional leaky section 610; the second end 612 of the additional leaky section 610 may be coupled in use to the first end 614 of the leaky coaxial conductor forming termination section 616 (if utilized); and the distal end 618 of the leaky coaxial conductor forming termination section 616 may be coupled, if used and in use, to the matched termination impedance 670. The center conductor 305 of the impedance matching section(s) 604, the center conductor 205 of the 1 additional leaky section 610 and center conductor 305 the termination section are electrically continuous. The electrically conductive outer layers of the impedance matching sections 604, the leaky coaxial conductor 604 and the first termination impedance are electrically continuous Preferably, if a termination section 616 is utilized, then the center conductor 605 and the surrounding dielectric sheath or core 615 have the same dimensions and materials for the impedance matching section 604, the additional leaky section 610 and the termination section 616.

In FIG. 6*a* the impedance matching section is depicted as being attached directly to transceiver 440, but it is to be understood, that alternatively two (or more) antennas 600 may be utilized and coupled to the transceiver 440 via a splitter 430 as shown in FIG. 4*b*.

The electrically conductive layer 609 of the leaky coaxial conductor forming the impedance matching section 604 and the leaky coaxial conductor 609 forming the termination section 616 may be formed by a conductive film or strip 325 disposed in a first helix and a conductive film or strip 335 disposed in a second helix, wherein the second helix may be counter-wound with respect to the first helix. An impedance of the antenna 600 may be controlled by varying of the width and/or diameter of the electrically conductive layer 609 and by varying the widths and pitches of the conductive film or strips 325, 335.

The leaky coaxial cable of the impedance matching section 604 and the leaky coaxial cable of the termination section 616 are each preferably substantially a quarter-wave long for the center frequency at which the antenna 600 is designed to operate. The thickness and diameter of the electrically conductive layer 609 may be selected from a range of dimensions. The antenna 600 is preferably made flexible for integration into an apparel item 405 as shown in FIGS. 4*a* and 4*b*. If the coaxial cables utilized have a sufficiently small diameter that they can be easily mated to SMA style connectors, then they should be easily integrated into the apparel item 405.

The antenna 600, for example, may be made up a number of quarter-wave, or $\lambda/4$, lengths of cables with double helixes in the outer electrically conductive layer 609 to form the impedance matching section(s) 604 and the termination section 616. The additional leaky section 610 with a single helix in the outer electrically conductive layer 609 thereof would be then used as shown in FIG. 6*a* between the impedance matching section(s) 604 and the termination section 616. The length of the additional leaky section 610 will likely depend on the application of its use, but for a garment or apparel item this length is apt to fall in the range of 1 to 2 meters. The lengths of the impedance matching section(s) 604 and the termination section 616 will depend on the frequency band for which the antenna 600 is designed, but those skilled in the art will realize that these sections will typically be much shorter than the additional leaky section 610. The outer electrically conductive layer 609 of antenna 600 may smoothly transition from a double helix to a single helix and back to a double helix along its length with the diameter of both the center conductor 605 and the dielectric sheath or core 615 remaining constant along their lengths. The double helix of the impedance matching section 604 may be adapted to match the impedance of the single helix of the additional leaky section 610.

As shown on FIG. 6*a*, $Z_0$ is the impedance of the radio transceiver 440 and of the matched termination impedance 670. The impedance of the single helix of the additional leaky section 610 is $Z_{leaky}$. Accordingly, the impedance of the impedance matching section 604 formed with double helix electrically conductive layer 609 and preferably having a length L equal to a quarter wavelength of the operating frequency of the antenna should preferably be $\sqrt{Z_{leaky} \cdot Z_o}$. If multiple impedance matching sections 604 are utilized in a series of such section, then this formula needs to be adjusted to account for the impedance Z at each end of each matching section 604.

The additional leaky section 610 with its single helical wound outer conductor provides efficient radiation. The impedance matching section(s) 604, 616 of leaky coaxial cable with double helical wound outer conductive film or strips 325, 335 are used to provide an impedance match between the single wound additional leaky section 610 and the radio transceiver 440 and a matched termination impedance 670 (if utilized). By virtue of the characteristic impedance simulations presented in the graph of FIG. 5, a coaxial cable with the single helix arranged outer conductive film or strip 225 has a higher characteristic impedance than a coaxial cable with double helix arranged conductive film or strips 325, 335. It is known in the art that a matching section of coaxial cable with a double wound helix outer conductor should be λ/4 in length, where λ is a center wavelength for the frequency band of operation of the antenna 600, and the impedance of the matching section should be $\sqrt{Z_{leaky} \cdot Z_o}$ where is the impedance of the radio transceiver and also the matched termination impedance 670, and $Z_{leaky}$ is the impedance of the single wound additional leaky section 610. As an example, if a matched leaky coaxial antenna with a Teflon dielectric sheath or core 615 is designed to operate-around a center frequency of 1 GHz, then a possible design would have the following parameters:

Single helix section (additional leaky section 610): conductive tape width=0.3 cm, pitch=0.5 cm, and characteristic impedance=85Ω.

For connection between a 50Ω transceiver and a 50Ω termination, include double wound impedance matching sections 604, 616 having a conductive tape width=0.15 cm, pitch=0.5 cm, length=5.2 cm, and characteristic impedance=65 Ω.

Figure 7:
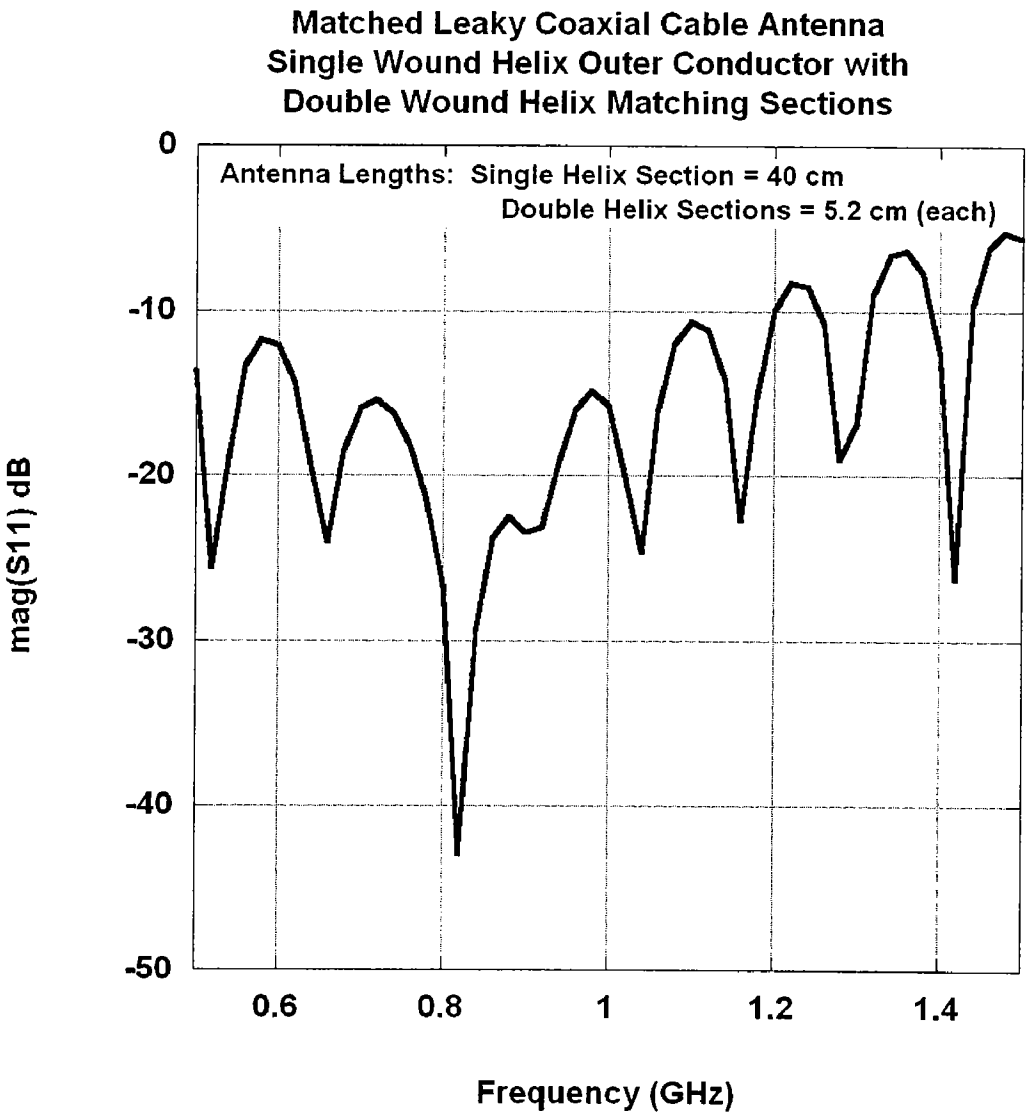
FIG. 7 illustrates a plot of frequency versus a forward reflection coefficient ($S_{11}$) for a matched antenna having a double helix.

FIG. 7 illustrates a plot of frequency versus a forward reflection coefficient ($S_{11}$) for a antenna 600 having single and double helix sections. This plot has been generated from a computer simulation for the additional leaky section 610 with a length of 40 cm and impedance matching sections 604, 616 with a length of 5.2 cm for each (the impedance matching section 604 and termination section 616). It may be noted that there is a substantial dip in the magnitude of $S_{11}$ at a frequency slightly above 800 MHz and the maximum return loss is better than 15 dB from below 640 MHz to above 1060 MHz.

Figure 8:
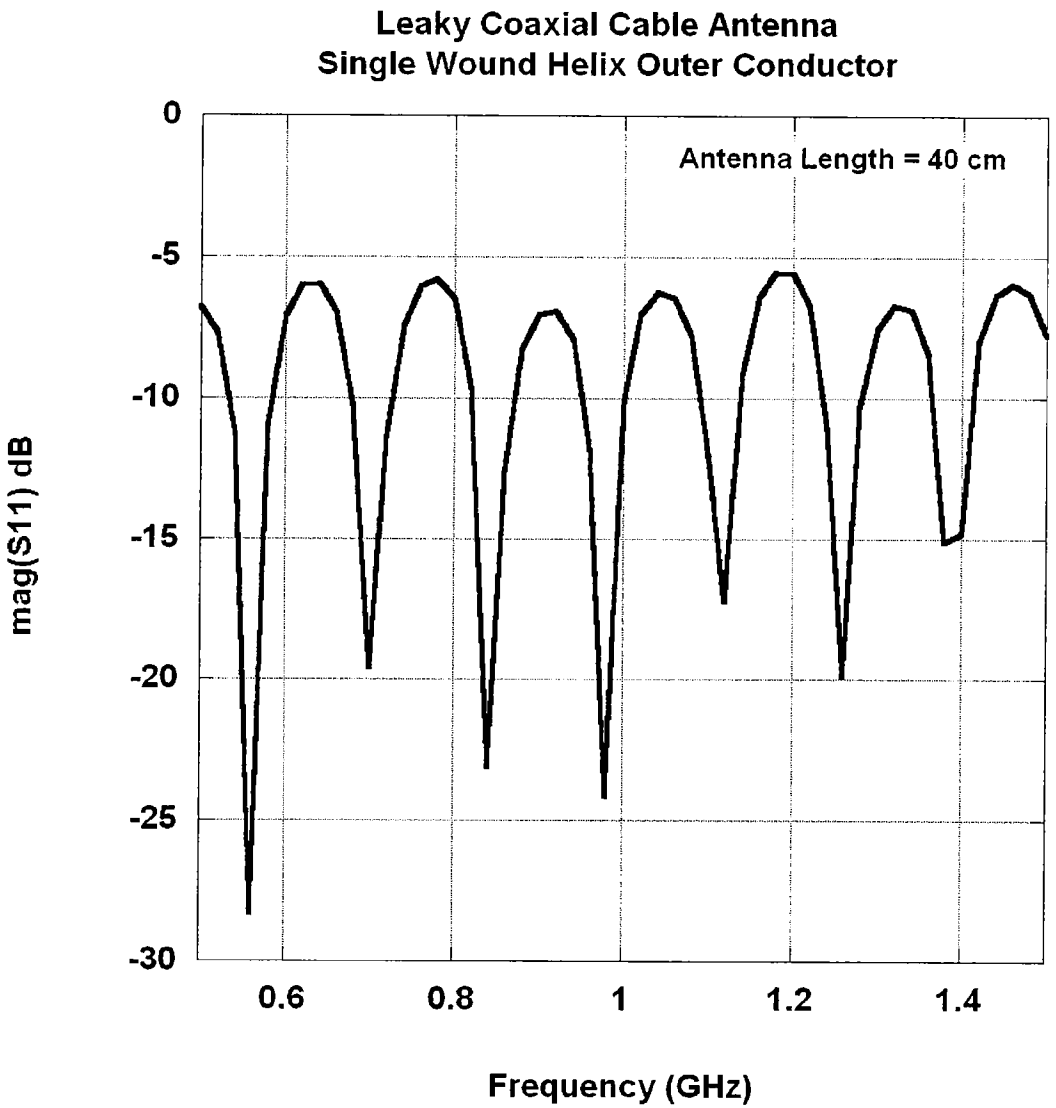
FIG. 8 illustrates a plot of frequency versus the forward reflection coefficient ($S_{11}$) for an unmatched antenna having a single helix.

FIG. 8 illustrates the plot of frequency versus the forward reflection coefficient ($S_{11}$) for an unmatched antenna having only a single helix. This plot has been generated from a computer simulation for a single helix length of 40 cm. In contrast to the plot of FIG. 7, the return loss is about 7 db from 500 MHz to 1500 MHz. The impedance match of the antenna 600 of the present disclosure may be extended in a desired bandwidth through the use of multiple quarter-wave impedance matching sections 604 as opposed to the single quarter-wave matching section 604 assumed for the graph of FIG. 7.

When designing a leaky wave coaxial antenna, for a desired length of coaxial cable forming the additional leaky section 610, design its outer conductor 609 to assume a single helix pattern having a helix pitch and helix width and adjust the helix width and pitch to produce a desired rate of RF leakage along the given length of the additional leaky section 610. Then calculate an input impedance $Z_{leaky}$ for the given length of the additional leaky section 610. Next determine the quarter-wave transformer impedances using the formulas provided above and determine the number of quarter wave sections needed to impedance match the calculated input impedance $Z_{leaky}$ with a characteristic impedance Zo of the one or more transceivers 440 to for which the antenna 600 is being designed to operate with. Then design the one or more needed quarter wave sections 604 as quarter-wave lengths of leaky coaxial cable having and outer conductor assuming a double helix pattern with a helix pitch and helix width and adjusting the helix width and pitch to realize the quarter-wave transformer impedances determined above. Ideally, the diameters and materials of the center conductor 605 and the dielectric sheath or core 615 should remain constant along the entire length of the antenna 600.

The helix pitch and width in the additional leaky section 610 may be designed to vary along the given length of coaxial cable so that for each unit length of cable the same amount of RF energy will leak therefrom. $Z_{leaky}$ will change along the length of the line. It will also cause the impedance seen by the matched termination impedance 670 to change with frequency. This should be taken into account in the design of the termination section 616, which is no longer straight-forward. However, if the impedance $Z_{leaky}$ changes slowly along the length of the additional leaky section 610, and if the RF signal radiates away substantially by the end of the antenna 612 there is no need for a matched termination at the distal end of the antenna, then the only impedance transformation that needs to occur is that between the 50 ohm source impedance at the transceiver 440 and the impedance of the section of single wound helix of the additional leaky section 610, which impedance transformation is performed by a preferably quarter wave sized impedance matching section 604.

Figure 9:
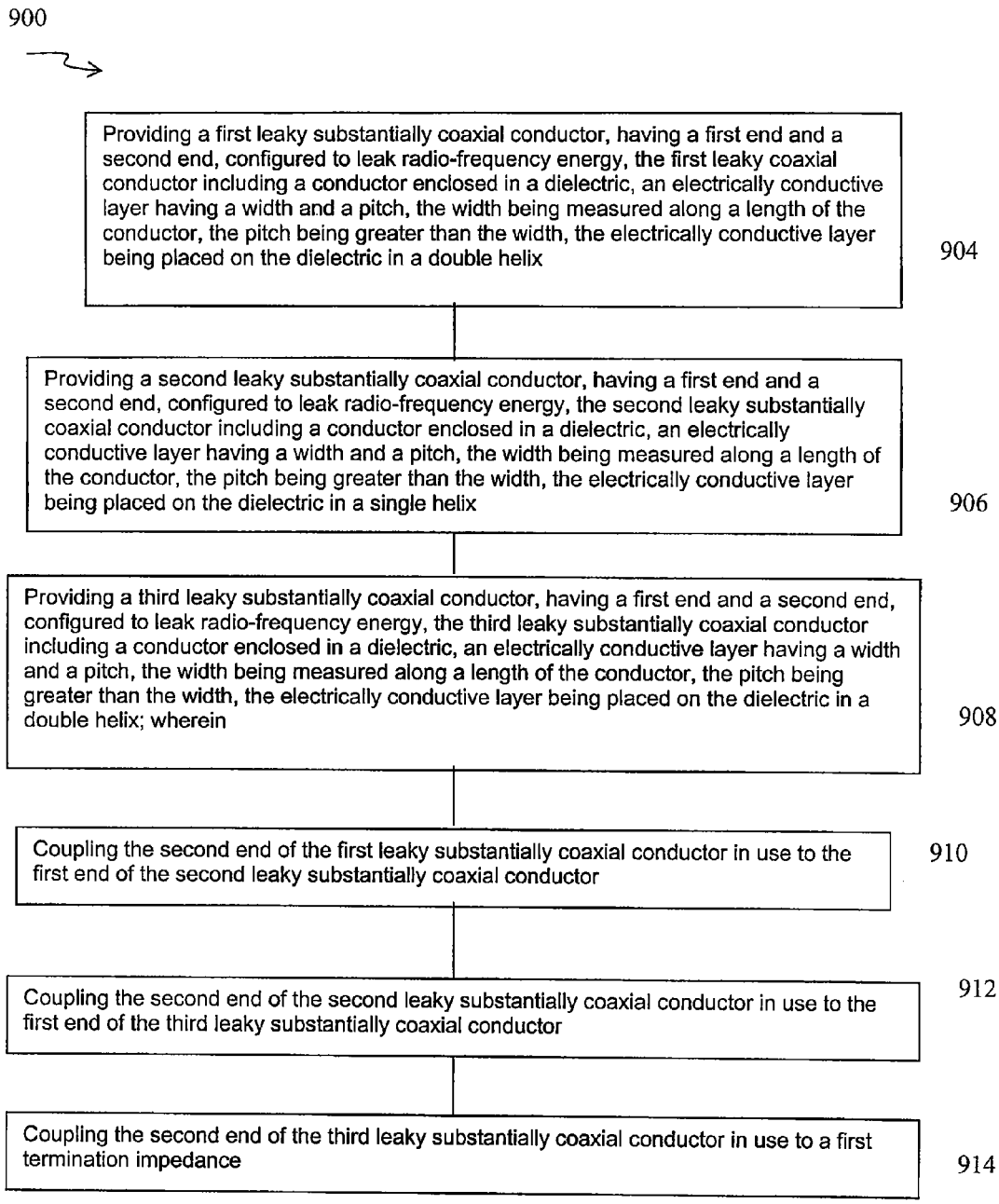
FIG. 9 is a flowchart of a first embodiment of a method of making the antenna.

FIG. 9 is a flowchart of a first embodiment of a method 900 of making the antenna 600. The method 900 preferably includes providing a impedance matching section 604 having a first substantially leaky coaxial cable, having a first end and a second end, configured to leak radio-frequency energy, the first leaky coaxial cable including a center conductor 305, 605 enclosed in a dielectric sheath or core 315, 615, an electrically conductive layer 609 formed by a conducting film or strips 325, 335 having a width and a pitch, the width being measured along a length of the center conductor 305, 605, the pitch being greater than the width, with conducting film or strips 325, 335 being placed on the dielectric or core 315, 615 in a double helix pattern (block 904). The method also includes providing an additional leaky section 610, having a first end and a second end, configured to leak radio-frequency energy, the additional leaky section 610 having a center conductor 205, 605 enclosed in a dielectric sheath or core 215, 615, an electrically conductive layer 609 formed by conducting film or strip 225 having a width and a pitch, the width being measured along a length of the center conductor 605, the pitch being greater than the width, the electrically conductive layer 609 being placed on the dielectric sheath or core 215, 615 in a single helix pattern (block 906).

The method optionally includes providing yet another substantially leaky coaxial cable forming a termination section 616, the termination section 616 having a first end and a second end and being configured to leak radio-frequency energy. The yet another substantially leaky coaxial cable forming termination section 616 includes a center conductor 605 enclosed in a dielectric sheath or core 615, an electrically conductive layer 609 formed by conducting film or strip 325, 335 having a width and a pitch, the width being measured along a length of the center conductor 605, the pitch being greater than the width, the conducting film or strips 325, 335 being placed on the dielectric sheath or core 615 in form of a double helix pattern (block 908). The second end of the impedance matching section 604 is coupled to the first end of the additional leaky section 610 (block 910). The second end of the additional leaky section 610 is preferably coupled to the first end of termination section 616 (block 912). The second end of the termination section 616 (if used) is preferably coupled to the matches termination impedance 670 (block 914).

The method 900 may further include providing a second antenna more or less identical to that described above. The first and second antennas (or even more antennas) may be coupled to a common transceiver 440 using one or more splitters 430.

The method 900 may further include placing the electrically conductive layer 609 of (i) the impedance matching section 604 and (ii) the additional leaky section 610 to form at least a common first helix of conducting film or strips 225, 325 for both sections 604 and 610 on a common dielectric sheath or core 615 (having a common center conductor 605) and to form a second helix of conducting film or strips 335 for the impedance matching section 604 only, wherein the placing of the conducting film or strips 335 of the second helix is as counter-winding on conducting film or strips 335 defining the first helix 325 in the impedance matching section 604 only. Similarly, if a termination section 616 is utilized, then it may share a common center conductor 605 and a common dielectric sheath or core 615 with sections 604 and 610. In that case, it may also share a common first helix of conducting film or strips 325 with both sections 604 and 610 and its second helix of conducting film or strips 335 may be formed at more or less the same time and of the same materials as the second helix of conducting film or strips 335 of impedance matching section 604.

The method 900 may further include controlling an impedance of the antenna by a variation of the width and pitch of the electrically conductive layer 609 of the additional leaky section 610. The method 900 may further include coupling in a substantially impedance-matching manner one of: the second end of the first leaky substantially coaxial conductor and the first end of the second leaky substantially coaxial conductor; and the second end of the second leaky substantially coaxial conductor and the first end of the third leaky substantially coaxial conductor.

The method 900 may further include dimensioning one of the first leaky substantially coaxial conductor and the yet another leaky substantially coaxial conductor to be substantially quarter-wave long. The method 900 may further include adapting the antenna for attaching to a article of clothing.

As a person having ordinary skill in the art would appreciate, the elements or blocks of the methods described above could take place at the same time or in an order different from the described order.

It should be emphasized that the above-described embodiments are merely some possible examples of implementation, set forth for a clear understanding of the principles of the disclosure. Many variations and modifications may be made to the above-described embodiments of the invention without departing substantially from the principles of the invention. All such modifications and variations are intended to be included herein within the scope of this disclosure and the present invention and protected by the following claims.

What is claimed is:

1. An antenna for a telecommunications device having a characteristic output impedance, the antenna comprising:

at least one impedance matching section comprising a leaky coaxial cable having a first end for attachment either to said telecommunications device or to a preceding impedance matching section, the leaky coaxial conductor being configured to leak radio-frequency energy, the leaky coaxial cable including a center conductor enclosed in a dielectric and an electrically conductive layer forming a double helix of conductive elements disposed on said dielectric, the conductive elements each having a width and a pitch, the widths and pitches being measured along a length of the leaky coaxial cable, the pitch of the conductive elements in said double helix being greater than the width of the conductive elements in said double helix;

an additional leaky section having a first end coupled to a second end of said at least one impedance matching section, the additional leaky section being configured to leak radio-frequency energy, the additional leaky section including a center conductor enclosed in a dielectric and an electrically conductive layer forming a single helix of conductive elements disposed on said dielectric, the conductive elements having a width and a pitch, the width and pitch being measured along a length of the additional leaky section, the pitch of the conductive elements in said single helix being greater than the width of the conductive elements in said single helix, and a termination section coupled to a second end of the additional leaky section, the termination section comprising yet another leaky coaxial cable configured to leak radio-frequency energy, the yet another leaky coaxial cable having a center conductor enclosed in a dielectric and an electrically conductive layer forming a double helix of conductive elements disposed on said dielectric, the conductive elements having a width and a pitch, the width and pitch being measured along a length of the yet another leaky coaxial cable, the pitch of the conductive elements in said termination section being greater than the width of the conductive elements in said termination section, wherein the additional leaky section has a characteristic impedance higher than the characteristic output impedance of the telecommunications device and wherein at least one of said impedance matching sections is coupled, in use, between the telecommunications device and the additional leaky section.

2. The antenna according to claim 1 wherein the first mentioned leaky coaxial cable and the additional leaky section share a common center conductor and a common dielectric surrounding the common center conductor.

3. The antenna according to claim 2 wherein the first mentioned leaky coaxial cable is shorter in length than is the additional leaky section.

4. The antenna according to claim 1 wherein the first mentioned leaky coaxial cable, the additional leaky section and the yet another leaky coaxial cable share a common center conductor and a common dielectric surrounding the common center conductor.

5. The antenna according to claim 4 wherein the additional section is longer in length than either the first mentioned leaky coaxial cable and the yet another leaky coaxial cable.

6. The antenna according to claim 1 wherein said termination section has a length which is the same as a length of the first mentioned leaky coaxial cable.

7. An antenna for a telecommunications device having a characteristic output impedance, the antenna comprising:

at least one impedance matching section comprising a leaky coaxial cable having a first end for attachment either to said telecommunications device or to a preceding impedance matching section, the leaky coaxial conductor being configured to leak radio-frequency energy, the leaky coaxial cable including a center conductor enclosed in a dielectric and an electrically conductive layer forming a double helix of conductive elements disposed on said dielectric, the conductive elements each having a width and a pitch, the widths and pitches being measured along a length of the leaky coaxial cable, the pitch of the conductive elements in said double helix being greater than the width of the conductive elements in said double helix; and an additional leaky section having a first end coupled to a second end of said at least one impedance matching section and having a second end, the additional leaky section being configured to leak radio-frequency energy, the additional leaky section including a center conductor enclosed in a dielectric and an electrically conductive layer forming a single helix of conductive elements disposed on said dielectric, the conductive elements having a width and a pitch, the width and pitch being measured along a length of the additional leaky section, the pitch of the conductive elements in said single helix being greater than the width of the conductive elements in said single helix, wherein the additional leaky section has a characteristic impedance higher than the characteristic output impedance of the telecommunications device and wherein at least one of said impedance matching sections is coupled, in use, between the telecommunications device and the additional leaky coaxial conductor; and wherein the first mentioned leaky coaxial cable and the additional leaky section comprise a first transmitting/receiving element, the antenna further comprising a second transmitting/receiving element also having a first mentioned leaky coaxial cable and an additional leaky section coaxial cable, the first and second transmitting/receiving elements being coupled, in use, to the telecommunications device via a splitter.

8. The antenna of claim 1, wherein the electrically conductive layer of the first mentioned leaky coaxial conductor and the yet another leaky coaxial conductor is placed to form at least a first helix and a second helix, wherein the second helix is counter-wound with respect to the first helix.

9. The antenna of claim 1, wherein one of the first mentioned leaky coaxial conductors and the yet another leaky coaxial conductor is substantially quarter-wave long at a nominal operating frequency of the antenna.

10. A leaky coaxial cable having first, second and third sections, the first, second and third sections of the leaky coaxial cable sharing a common center conductor and sharing a common dielectric sheath surrounding the center conductor, the first, second and third sections of the leaky coaxial cable having a leaky outer shield formed by conductive elements which are arranged in a double helix when disposed on said common dielectric sheath in said first and third sections and which are arranged in a single helix when disposed on common dielectric sheath in said second section.

11. A leaky coaxial cable according to claim 10 wherein the conductive elements have a width and a pitch, the width and pitch being measured along a length of the leaky coaxial cable, the pitch of the conductive elements being greater than the width of the conductive elements in both said first and second sections.

12. A method of making an antenna, the method comprising:

providing a first leaky coaxial cable configured to leak radio-frequency energy, the first leaky coaxial cable including an inner conductor enclosed in a dielectric with an electrically conductive outer layer disposed on the dielectric, the electrically conductive outer layer having a width and a pitch, the width being measured along a length of the cable, the pitch being greater than the width, the electrically conductive layer being placed on the dielectric in a double helix, the first leaky coaxial cable having a length essentially equal to a quarter wavelength at a nominal operating frequency of the antenna; and providing a second leaky coaxial cable configured to leak radio-frequency energy, the second leaky substantially coaxial cable including an inner conductor enclosed in a dielectric with an electrically conductive outer layer disposed on the dielectric, the electrically conductive outer layer of the second leaky cable having a width and a pitch, the width being measured along a length of the cable, the pitch being greater than the width, the electrically conductive layer being placed on the dielectric in a single helix, the second leaky coaxial cable having a length substantially longer than a quarter wavelength at the nominal operating frequency of the antenna, wherein the dielectric of the first and second leaky coaxial cables has a constant diameter throughout said first and second leaky coaxial cables; and wherein the inner conductor of the first and second leaky coaxial cables is an integral member for first and second leaky coaxial cables having a constant diameter throughout said first and second leaky coaxial cables.

13. The method of claim 12 further including providing a third leaky coaxial cable, having a first end and a second end, configured to leak radio-frequency energy, the third leaky substantially coaxial conductor including an inner conductor enclosed in a dielectric with an electrically conductive layer disposed on the dielectric of the third leaky coaxial cable, the electrically conductive layer having a width and a pitch, the width being measured along a length of the cable, the pitch being greater than the width, the electrically conductive layer being placed on the dielectric in a double helix, the third leaky coaxial cable having a length essentially equal to a quarter wavelength at a nominal operating frequency of the antenna, wherein the dielectric of the first, second and third leaky coaxial cables has a constant diameter throughout said first, second and third leaky coaxial cables; and wherein the inner conductor of the first, second and third leaky coaxial cables is an integral member first, second and third leaky coaxial cables having a constant diameter throughout said first, second and third leaky coaxial cables.

14. The method of claim 12 wherein the antenna is integrated into to an item of clothing.

15. A method of making an antenna, the method comprising:

providing a plurality of first leaky coaxial cables each configured to leak radio-frequency energy, each first leaky coaxial cable including an inner conductor enclosed in a dielectric with an electrically conductive outer layer disposed on the dielectric, the electrically conductive outer layers having a width and a pitch, the width being measured along a length of the cable, the pitch being greater than the width, the electrically conductive layers being placed on the dielectric in a double helix, the plurality of first leaky coaxial cables each having a length essentially equal to a quarter wavelength at a nominal operating frequency of the antenna; and providing a second leaky coaxial cable configured to leak radio-frequency energy, the second leaky substantially coaxial cable including an inner conductor enclosed in a dielectric with an electrically conductive outer layer disposed on the dielectric, the electrically conductive outer layer of the second leaky cable having a width and a pitch, the width being measured along a length of the cable, the pitch being greater than the width, the electrically conductive layer being placed on the dielectric in a single helix, the second leaky coaxial cable having a length substantially longer than a quarter wavelength at the nominal operating frequency of the antenna, wherein the dielectric of the plurality of first leaky coaxial cables and the dielectric of the second leaky coaxial cable have a constant diameter throughout said plurality of first and said second leaky coaxial cables; and wherein the inner conductor of the said plurality of first and said second leaky coaxial cables is an integral member for said plurality of first and said second leaky coaxial cables having a constant diameter throughout said said plurality of first and said second leaky coaxial cables.

16. The method of claim 15 further including providing a third leaky coaxial cable, having a first end and a second end, configured to leak radio-frequency energy, the third leaky substantially coaxial conductor including an inner conductor enclosed in a dielectric with an electrically conductive layer disposed on the dielectric of the third leaky coaxial cable, the electrically conductive layer having a width and a pitch, the width being measured along a length of the cable, the pitch being greater than the width, the electrically conductive layer being placed on the dielectric in a double helix, the third leaky coaxial cable having a length essentially equal to a quarter wavelength at the nominal operating frequency of the antenna, wherein the dielectric of the said first, said second and said third leaky coaxial cables has a constant diameter throughout said first, said second and said third leaky coaxial cables; and wherein the inner conductor of the said first, said second and said third leaky coaxial cables is an integral member having a constant diameter throughout said first, second and third leaky coaxial cables.

17. The method of claim 15 wherein the antenna is fixed to an item of clothing.

18. A method of designing a leaky wave coaxial antenna comprising:

(i) for a given length of coaxial cable, designing its outer conductor to assume a single helix pattern having a helix pitch and helix width and adjusting the helix width and pitch to produced a desired rate of RF leakage along said given length of coaxial cable of said antenna;

(ii) after performing step (i), calculate an input impedance for said given length of coaxial cable;

(iii) determining quarter-wave transformer impedances and a number of quarter wave sections needed to impedance match the input impedance calculated in step (ii) with a characteristic impedance of one or more transceivers to for which the antenna is being designed; and (iv) designing the one or more needed quarter wave sections as quarter-wave lengths of leaky coaxial cable having and outer conductor assuming a double helix pattern with a helix pitch and helix width and adjusting the helix width and pitch to realize the quarter-wave transformer impedances determined in step (iii).

19. The method of claim 18 wherein in step (i) the helix pitch and width is designed to vary along the given length of coaxial cable so that for each unit length of cable the same amount of RF energy will leak therefrom.

20. An antenna which operates at a nominal operating frequency, the antenna comprising:

a first leaky coaxial cable configured to leak radio-frequency energy, the first leaky coaxial cable including an inner conductor enclosed in a dielectric with an electrically conductive outer layer disposed on the dielectric, the electrically conductive outer layer having a width and a pitch, the width being measured along a length of the cable, the pitch being greater than the width, the electrically conductive layer being placed on the dielectric in a double helix, the first leaky coaxial cable having a length essentially equal to a quarter wavelength at the nominal operating frequency of the antenna; and a second leaky coaxial cable configured to leak radio-frequency energy, the second leaky substantially coaxial cable including an inner conductor enclosed in a dielectric with an electrically conductive outer layer disposed on the dielectric, the electrically conductive outer layer of the second leaky cable having a width and a pitch, the width being measured along a length of the cable, the pitch being greater than the width, the electrically conductive layer being placed on the dielectric in a single helix, the second leaky coaxial cable having a length substantially longer than a quarter wavelength at the nominal operating frequency of the antenna, wherein the dielectric of the first and second leaky coaxial cables has a constant diameter throughout said first and second leaky coaxial cables; and wherein the inner conductor of the first and second leaky coaxial cables has a constant diameter throughout said first and second leaky coaxial cables.

21. The antenna of claim 20 further including a third leaky coaxial cable, having a first end and a second end, configured to leak radio-frequency energy, the third leaky substantially coaxial conductor including an inner conductor enclosed in a dielectric with an electrically conductive layer disposed on the dielectric of the third leaky coaxial cable, the electrically conductive layer having a width and a pitch, the width being measured along a length of the cable, the pitch being greater than the width, the electrically conductive layer being placed on the dielectric in a double helix, the third leaky coaxial cable having a length essentially equal to a quarter wavelength at a nominal operating frequency of the antenna, wherein the dielectric of the first, second and third leaky coaxial cables has a constant diameter throughout said first, second and third leaky coaxial cables; and wherein the inner conductor of the first, second and third leaky coaxial cables has a constant diameter throughout said first, second and third leaky coaxial cables.

22. The antenna of claim 20 wherein the antenna is integrated into to an item of clothing.

* * * * *